US009851130B2

(12) United States Patent
Love et al.

(10) Patent No.: US 9,851,130 B2
(45) **Date of Patent: *Dec. 26, 2017**

(54) ELECTRONICS COOLING USING LUBRICANT RETURN FOR A SHELL-AND-TUBE STYLE EVAPORATOR

(71) Applicant: TRANE INTERNATIONAL INC., Piscataway, NJ (US)

(72) Inventors: Todd J. Love, Onalaska, WI (US); Jon P. Hartfield, La Crosse, WI (US); Benjamin Elias Dingel, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 247 days.

This patent is subject to a terminal disclaimer.

(21) Appl. No.: 14/714,650

(22) Filed: May 18, 2015

(65) Prior Publication Data

US 2015/0300707 A1 Oct. 22, 2015

Related U.S. Application Data

(63) Continuation of application No. 13/427,228, filed on Mar. 22, 2012, now Pat. No. 9,032,753.

(51) Int. Cl.
*F25B 31/00* (2006.01)
*F25B 31/02* (2006.01)
(Continued)

(52) U.S. Cl.
CPC ..... *F25B 31/004* (2013.01); *F25B 31/002* (2013.01); *F25B 31/026* (2013.01); *F25B 39/028* (2013.01); *F25B 41/003* (2013.01); *F25B 2339/0242* (2013.01); *F25B 2400/05* (2013.01)

(58) Field of Classification Search
CPC .... F25B 31/004; F25B 31/002; F25B 31/026; F25B 39/028; F25B 41/003
See application file for complete search history.

(56) References Cited

U.S. PATENT DOCUMENTS 3,270,521 A 9/1966 Rayner et al.
3,548,612 A 12/1970 Mitsubayashi et al.
(Continued)

FOREIGN PATENT DOCUMENTS

CN 1185203 6/1998
CN 1692262 11/2005
(Continued)

OTHER PUBLICATIONS

First Chinese Office Action for Chinese Application No. 2013800272739, dated Nov. 3, 2015, 16 pgs. (Partial English Translation pp. 1-3, Office Action pp. 4-16).
(Continued)

*Primary Examiner* — Dominick L Plakkoottam
*Assistant Examiner* — Raheena R Malik
(74) *Attorney, Agent, or Firm* — Hamre, Schumann, Mueller & Larson, P.C.

(57) ABSTRACT

A refrigeration system that induces lubricant-liquid refrigerant mixture flow from a flooded or falling film evaporator by means of the lubricant-liquid refrigerant mixture flow adsorbing heat from an electronic component.

19 Claims, 6 Drawing Sheets

(51) Int. Cl.
*F25B 39/02* (2006.01)
*F25B 41/00* (2006.01)

(56) References Cited

U.S. PATENT DOCUMENTS

| | | | | |
|---|---|---|---|---|
| 3,563,051 | A | 2/1971 | Baumgartner | |
| 3,820,350 | A | 6/1974 | Brandin et al. | |
| 4,178,765 | A | 12/1979 | Slayton | |
| 4,210,001 | A | 7/1980 | Miller, Sr. | |
| 4,254,637 | A | 3/1981 | Brauch et al. | |
| 4,429,544 | A | 2/1984 | McCarty | |
| 4,720,981 | A | 1/1988 | Helt et al. | |
| 5,429,179 | A | 7/1995 | Klausing | |
| 5,502,984 | A | 4/1996 | Boehde et al. | |
| 5,590,539 | A | 1/1997 | Marohl et al. | |
| 5,645,124 | A | 7/1997 | Hartfield et al. | |
| 5,894,740 | A | 4/1999 | Renz | |
| 5,899,091 | A | 5/1999 | Fraser, Jr. et al. | |
| 6,058,727 | A | 5/2000 | Fraser, Jr. et al. | |
| 6,067,804 | A | 5/2000 | Moeykens et al. | |
| 6,116,040 | A | 9/2000 | Stark | |
| 6,170,286 | B1 | 1/2001 | Keuper | |
| 6,182,467 | B1 | 2/2001 | Zhong et al. | |
| 6,467,300 | B1 | 10/2002 | Noble, III | |
| 6,672,102 | B1 | 1/2004 | Huenniger et al. | |
| 7,003,971 | B2 | 2/2006 | Kester et al. | |
| 9,032,753 | B2 * | 5/2015 | Love | F25B 31/002 62/468 |
| 9,032,754 | B2 * | 5/2015 | Love | F25B 1/047 62/468 |
| 2009/0126376 | A1 | 5/2009 | Knoll | |
| 2010/0186410 | A1 * | 7/2010 | Cogswell | F01K 25/10 60/671 |

FOREIGN PATENT DOCUMENTS

| | | |
|---|---|---|
| JP | 2007-327668 | 12/2007 |
| JP | 2012-007825 | 1/2012 |
| KR | 10-1998-0033183 | 7/1998 |
| WO | 2009/056527 | 5/2009 |

OTHER PUBLICATIONS

Extended European Search Report for European Application No. 13765223.6, dated Feb. 25, 2015, 7 pgs.

Extended European Search Report for European Application No. 13765192.3, dated Feb. 25, 2015, 6 pgs.

PCT/US2013/0306586 International Search Report and Written Opinion dated Jun. 24, 2013, 8 pages.

* cited by examiner

MINIMUM REFRIGERATION CAPACITY IN TONS FOR OIL ENTRAINMENT UP SUCTION RISERS

| REFRIG-ERANT | SATIRATED SUCTION TEMP.,°F | SUCTION GAS TEMP.,°F | PIPE OD, in. 1/2 | 5/8 | 3/4 | 7/8 | 1 1/8 | 1 3/8 | 1 5/8 | 2 1/8 | 2 5/8 | 3 1/8 | 3 5/8 | 4 1/8 |
|---|---|---|---|---|---|---|---|---|---|---|---|---|---|---|
| | | | AREA, $in^2$ | | | | | | | | | | | |
| | | | 0.146 | 0.233 | 0.348 | 0.484 | 0.825 | 1.256 | 1.780 | 3.094 | 4.770 | 6.812 | 9.213 | 11.970 |
| 22 | -40.0 | -30.0 | 0.067 | 0.119 | 0.197 | 0.298 | 0.550 | 0.981 | 1.52 | 3.03 | 5.20 | 8.12 | 11.8 | 16.4 |
| | | -10.0 | 0.065 | 0.117 | 0.194 | 0.292 | 0.570 | 0.963 | 1.49 | 2.97 | 5.11 | 7.97 | 11.6 | 16.1 |
| | | 10.0 | 0.066 | 0.118 | 0.195 | 0.295 | 0.575 | 0.972 | 1.50 | 3.00 | 5.15 | 8.04 | 11.7 | 16.3 |
| | 20.0 | 10.0 | 0.087 | 0.156 | 0.258 | 0.389 | 0.758 | 1.28 | 1.98 | 3.96 | 6.80 | 10.6 | 15.5 | 21.5 |
| | | 10.0 | 0.085 | 0.153 | 0.253 | 0.362 | 0.744 | 1.26 | 1.95 | 3.88 | 6.67 | 10.4 | 15.2 | 21.1 |
| | | 30.0 | 0.086 | 0.154 | 0.254 | 0.383 | 0.747 | 1.26 | 1.95 | 3.90 | 6.69 | 10.4 | 15.2 | 21.1 |
| | 0.0 | 10.0 | 0.111 | 0.199 | 0.328 | 0.496 | 0.986 | 1.63 | 2.53 | 5.04 | 8.66 | 13.5 | 19.7 | 27.4 |
| | | 30.0 | 0.108 | 0.194 | 0.320 | 0.484 | 0.943 | 1.59 | 2.46 | 4.92 | 8.45 | 13.2 | 19.2 | 26.7 |
| | | 50.0 | 0.109 | 0.195 | 0.322 | 0.486 | 0.946 | 1.60 | 2.47 | 4.94 | 8.48 | 13.2 | 19.3 | 26.8 |
| | 20.0 | 30.0 | 0.126 | 0.244 | 0.403 | 0.608 | 1.18 | 2.00 | 3.10 | 6.18 | 10.6 | 16.6 | 24.2 | 33.5 |
| | | 50.0 | 0.135 | 0.242 | 0.399 | 0.603 | 1.17 | 1.99 | 3.07 | 6.13 | 10.5 | 16.4 | 24.6 | 33.3 |
| | | 70.0 | 0.135 | 0.242 | 0.400 | 0.605 | 1.18 | 1.99 | 3.08 | 6.15 | 10.6 | 16.5 | 24.0 | 33.5 |
| | 40.0 | 50.0 | 0.167 | 0.300 | 0.495 | 0.748 | 1.46 | 2.46 | 3.81 | 7.60 | 13.1 | 20.4 | 29.7 | 41.3 |
| | | 70.0 | 0.165 | 0.296 | 0.488 | 0.737 | 1.44 | 2.43 | 3.75 | 7.49 | 12.9 | 20.1 | 29.3 | 40.7 |
| | | 90.0 | 0.165 | 0.296 | 0.488 | 0.738 | 1.44 | 2.43 | 3.76 | 7.50 | 12.9 | 20.1 | 29.3 | 40.7 |
| 134a | 0.0 | 10.0 | 0.089 | 0.161 | 0.259 | 0.400 | 0.78 | 1.32 | 2.03 | 4.06 | 4.06 | 10.9 | 15.9 | 22.1 |
| | | 30.0 | 0.075 | 0.135 | 0.218 | 0.336 | 0.66 | 1.11 | 1.71 | 3.42 | 3.42 | 9.2 | 13.4 | 18.5 |
| | | 50.0 | 0.072 | 0.130 | 0.209 | 0.323 | 0.63 | 1.07 | 1.64 | 3.28 | 3.28 | 8.8 | 12.8 | 17.8 |
| | 10.0 | 20.0 | 0.101 | 0.182 | 0.294 | 0.453 | 0.88 | 1.49 | 2.31 | 4.61 | 4.61 | 12.4 | 18.0 | 25.0 |
| | | 40.0 | 0.084 | 0.152 | 0.246 | 0.379 | 0.74 | 1.25 | 1.93 | 3.86 | 3.86 | 10.3 | 15.1 | 20.9 |
| | | 60.0 | 0.081 | 0.147 | 0.237 | 0.466 | 0.71 | 1.21 | 1.87 | 3.73 | 3.73 | 10.0 | 14.6 | 20.2 |
| | 20.0 | 30.0 | 0.113 | 0.205 | 0.331 | 0.510 | 0.99 | 1.68 | 2.60 | 5.10 | 5.10 | 13.9 | 20.3 | 28.7 |
| | | 50.0 | 0.095 | 0.172 | 0.277 | 0.427 | 0.83 | 1.41 | 2.17 | 4.34 | 4.34 | 11.6 | 17.0 | 23.6 |
| | | 70.0 | 0.092 | 0.166 | 0.268 | 0.413 | 0.81 | 1.36 | 2.10 | 4.20 | 4.20 | 11.3 | 16.4 | 22.8 |
| | 30.0 | 40.0 | 0.115 | 0.207 | 0.335 | 0.517 | 1.01 | 1.70 | 2.63 | 5.25 | 5.25 | 14.1 | 20.5 | 28.5 |
| | | 60.0 | 0.107 | 0.193 | 0.311 | 0.480 | 0.94 | 1.58 | 2.44 | 4.88 | 4.88 | 13.1 | 19.1 | 26.5 |
| | | 80.0 | 0.103 | 0.187 | 0.301 | 0.465 | 0.91 | 1.53 | 2.37 | 4.72 | 4.72 | 12.7 | 18.5 | 23.6 |
| | 40.0 | 50.0 | 0.128 | 0.232 | 0.374 | 0.577 | 1.12 | 1.90 | 2.94 | 5.87 | 5.87 | 15.7 | 22.9 | 31.8 |
| | | 70.0 | 0.117 | 0.212 | 0.342 | 0.528 | 1.03 | 1.74 | 2.69 | 5.37 | 5.37 | 14.4 | 21.0 | 29.1 |
| | | 90.0 | 0.114 | 0.206 | 0.332 | 0.512 | 1.00 | 1.69 | 2.61 | 5.21 | 5.21 | 14.0 | 20.4 | 28.1 |

| REFRIGERANT | LIQUID TEMPERATURE,°F 50 | 60 | 70 | 80 | 100 | 110 | 120 | 130 | 140 |
|---|---|---|---|---|---|---|---|---|---|
| 22 | 1.17 | 1.34 | 1.10 | 1.06 | 0.98 | 0.94 | 0.89 | 0.85 | 0.80 |
| 134a | 1.26 | 1.20 | 1.13 | 1.07 | 0.94 | 0.87 | 0.80 | 0.74 | 0.67 |

FIG. 9

ELECTRONICS COOLING USING LUBRICANT RETURN FOR A SHELL-AND-TUBE STYLE EVAPORATOR

BACKGROUND

The present invention relates to a refrigeration chiller, and more specifically, to an apparatus for recovering lubricant and ensuring high viscosity lubricant for a refrigerant compressor.

The compressor is typically provided with lubricant, such as oil, which is utilized to lubricate bearing and other running surfaces. The lubricant mixes with refrigerant, such that the refrigerant leaving the compressor includes a good quantity of lubricant. This is somewhat undesirable, as in the closed refrigerant system, it can sometimes become difficult to maintain an adequate supply of lubricant to lubricate the compressor surfaces. In the past, oil separators have been utilized immediately downstream of the compressor. While oil separators do separate the lubricant, they have not always provided fully satisfactory results. As an example, the lubricant removed from such a separator will be at a high pressure, and may have an appreciable amount of refrigerant still mixed in with the lubricant. This lowers the viscosity of the lubricant. The use of a separator can also cause a pressure drop in the compressed refrigerant, which is also undesirable.

SUMMARY

In one embodiment, the invention provides a refrigeration system including a compressor having a suction port and a discharge port, the compressor configured to receive refrigerant from the suction port, compress the refrigerant, and discharge the compressed refrigerant through the discharge port. The refrigeration system also has a condenser connected to the discharge port and configured to receive the compressed refrigerant from the compressor and condense the compressed refrigerant and an expansion device connected to the condenser and configured to receive the condensed refrigerant from the condenser. Also included as part of the refrigeration system is a shell-and-tube style evaporator having an inlet port, a first outlet port, and a second outlet port, wherein the evaporator is configured to receive refrigerant from the expansion device through the inlet port, evaporate a portion of the refrigerant, and discharge the evaporated portion of the refrigerant through the first outlet port to the suction port, the second outlet being in fluid flow communication with a location in the shell-and-tube style evaporator to which lubricant migrates during operation of the refrigeration system, the migrated lubricant mixing with liquid refrigerant in the shell-and-tube style evaporator to form a lubricant-liquid refrigerant mixture. In addition, the refrigeration system has a heat sink and a lubricant return line connecting the second outlet port to the suction port, wherein the lubricant return line is in heat exchange relationship with the heat sink such that heat is rejected from the heat sink to the lubricant-liquid refrigerant mixture to evaporate the liquid refrigerant in the lubricant-liquid refrigerant mixture to induce flow of the evaporated refrigerant and the lubricant in the lubricant-liquid refrigerant mixture to the compressor.

In another embodiment the invention provides a refrigeration system including a compressor having a suction port and a discharge port, the compressor configured to receive refrigerant from the suction port, a variable-speed-drive device connected to drive the compressor to compress the refrigerant and discharge the compressed refrigerant through the discharge port, a heat sink in heat exchange relationship to the variable-speed-drive device, a condenser connected to the discharge port and configured to receive the compressed refrigerant from the compressor and condense the compressed refrigerant and an expansion device connected to the condenser and configured to receive the condensed refrigerant from the condenser. The refrigeration system additionally includes a shell-and-tube style evaporator having an inlet port, a first outlet port, and a second outlet port, wherein the evaporator is configured to receive refrigerant from the expansion device through the inlet port, evaporate a portion of the refrigerant, and discharge the evaporated portion of the refrigerant through the first outlet port to the suction port, the second outlet being in fluid flow communication with a location in the shell-and-tube style evaporator to which lubricant migrates during operation of the refrigeration system, the migrated lubricant mixing with liquid refrigerant in the shell-and-tube style evaporator to form a lubricant-liquid refrigerant mixture. In addition, the refrigeration system has a lubricant return line connecting the second outlet port to the suction port, wherein the lubricant return line is in heat exchange relationship with the heat sink such that heat is rejected from the heat sink to the lubricant-liquid refrigerant mixture to cool the variable-speed-drive device and to evaporate the liquid refrigerant in the lubricant-liquid refrigerant mixture to induce flow of the evaporated refrigerant and the lubricant in the lubricant-liquid refrigerant mixture to the compressor.

In yet another embodiment the invention provides a refrigeration system including a compressor having a suction port and a discharge port, the compressor configured to receive refrigerant from the suction port, compress the refrigerant, and discharge the compressed refrigerant through the discharge port, a condenser connected to the discharge port and configured to receive the compressed refrigerant from the compressor and condense the compressed refrigerant and an expansion device connected to the condenser and configured to receive the condensed refrigerant from the condenser. The refrigeration system also has a shell-and-tube style evaporator having an inlet port, a first outlet port, and a second outlet port, wherein the evaporator is configured to receive refrigerant from the expansion device through the inlet port, evaporate a portion of the refrigerant, and discharge the evaporated portion of the refrigerant through the first outlet port to the suction port, the second outlet being in fluid flow communication with a location in the shell-and-tube style evaporator to which lubricant migrates during operation of the refrigeration system, the migrated lubricant mixing with liquid refrigerant in the shell-and-tube style evaporator to form a lubricant-liquid refrigerant mixture, a lubricant return line connecting the second outlet port to the suction port, a heat sink for an electronic device and a lubricant return heat exchanger connected to the lubricant return line. In addition, the refrigeration system has a coolant loop connecting the heat sink and the lubricant return heat exchanger and configured to circulate a coolant between the heat sink and the lubricant return heat exchanger such that heat from the electronic device is transferred to the heat sink, heat from the heat sink is transferred to the coolant, heat from the coolant is transferred to the lubricant-liquid refrigerant mixture in the lubricant return heat exchanger to cool the coolant, the heat sink, and the electronic device and to evaporate the liquid refrigerant in the lubricant-liquid refrigerant mixture to induce flow of the evaporated refrigerant and the lubricant in the lubricant-liquid refrigerant mixture to the compressor.

Other aspects of the invention will become apparent by consideration of the detailed description and accompanying drawings.

BRIEF DESCRIPTION OF THE DRAWINGS

FIG. 9 is a table titled "Minimum Refrigeration Capacity in Tons for Oil Entrainment up Suction Risers (Type L Copper Tubing)"

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Virtually all refrigeration chiller compressors employ or require the use of rotating parts to accomplish their compression purpose. Such rotating parts will, as is the case with virtually all rotating machinery, be carried in bearings, which will require lubrication. Typical also of most refrigeration chillers is the fact that at least some of the lubricant (typically oil) used to lubricate the bearings thereof will make its way into the refrigeration circuit as a result of its becoming entrained in the refrigerant gas that is discharged from the system's compressor. The embodiments described herein may employ at least one oil separator. The oil separator is able to remove some lubricant from a lubricant-refrigerant mixture, but is not able to remove all of the lubricant from the lubricant-refrigerant mixture. In a similar fashion, the oil separator is not able to remove only lubricant from the lubricant-refrigerant mixture, but rather, the oil separator removes lubricant with some refrigerant included therein. During the compression process, lubricant may be mixed with refrigerant resulting in a lubricant-refrigerant mixture.

Figure 1:
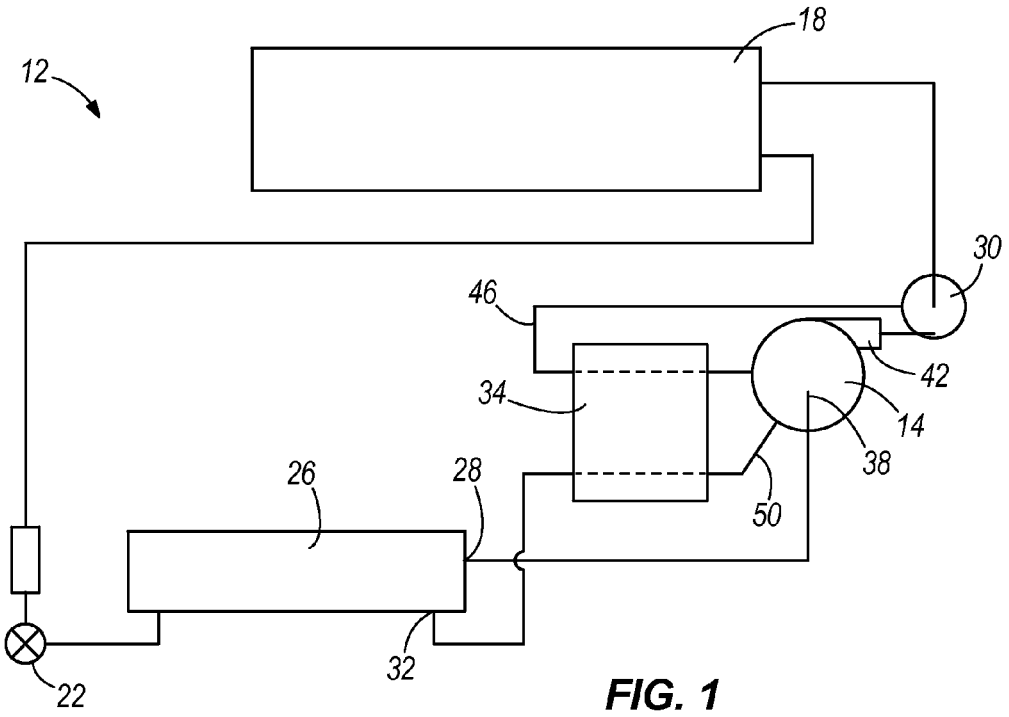
FIG. 1 is a schematic illustration of a refrigeration chiller.

A refrigeration system 12, schematically illustrated in FIG. 1, includes a compressor 14, a condenser 18, an expansion device 22, and an evaporator 26, all of which are fluidly connected for flow to form a refrigeration circuit. The compressor may be, by way of example only, a centrifugal compressor, a screw compressor or a scroll compressor. The expansion device 22 may be, by way of example only, an expansion valve. The refrigeration system 12 further includes an oil separator 30 and a heat exchanger 34.

Figure 6:
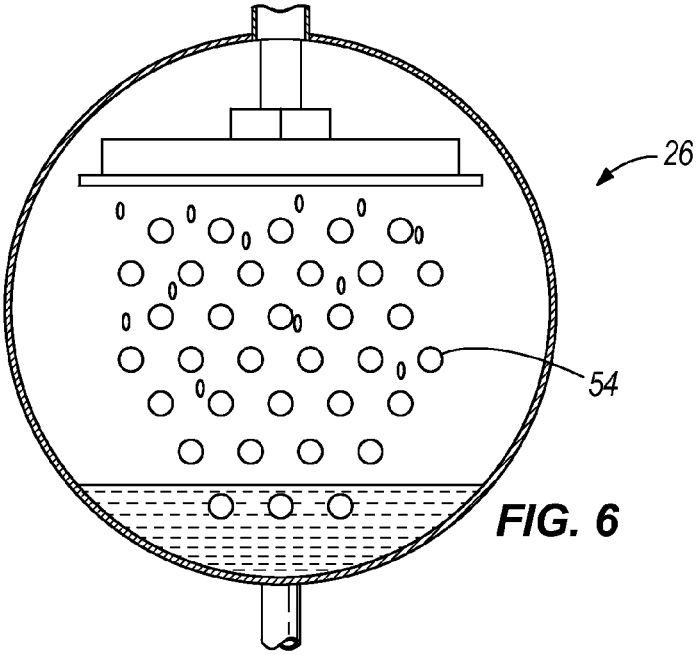
FIG. 6 is a schematic illustration of a falling film shell-and-tube style evaporator.

All embodiments described herein include the evaporator 26 which may be one of a falling film shell-and-tube style evaporator (see FIG. 6), a flooded shell-and-tube style evaporator (see FIG. 7), a flowing pool shell-and-tube style evaporator (see FIG. 8), or a variant of at least one of these evaporators. Additional information regarding the falling film shell-and-tube style evaporator can be found in U.S. Pat. No. 6,868,695, which is hereby incorporated by reference. Additional information regarding the flooded shell-and-tube style evaporator can be found in U.S. Pat. No. 4,829,786, which is hereby incorporated by reference. Additional information regarding the flowing pool shell-and-tube style evaporator can be found in U.S. Pat. No. 6,516,627, which is hereby incorporated by reference. For ease of describing the various embodiments herein, only the term evaporator will be used. The evaporator 26 serves to facilitate a vaporized refrigerant and lubricant-liquid refrigerant mixture adsorb heat from a medium to be cooled. In addition, the evaporator 26 allows lubricant to become concentrated in the lubricant-liquid refrigerant mixture that is not vaporized in the evaporator.

All of the embodiments described herein include the condenser 18. The condenser 18 utilized by the various embodiments may be a condenser or it may be a combination condenser/subcooler. If utilized, the subcooler portion serves to further cool the refrigerant. For ease of describing the various embodiments herein, only the term condenser will be used.

Returning now to the embodiment illustrated in FIG. 1, the compressor 14 includes a suction port 38, and a discharge port 42. First and second lubricant return lines 46, 50 provide lubricant to lubricate the compressor 14. The compressor 14 is configured to receive refrigerant from the suction port 38, compress the refrigerant, and discharge the compressed refrigerant from the discharge port 42. In operation, the compressor 14 compresses refrigerant gas, heating it and raising its pressure in the process, and then delivers the refrigerant to the oil separator 30 and then to the condenser 18. In the illustrated embodiment a screw compressor 14 is used, but use of other types of compressors 14, such as a centrifugal compressor, in the refrigeration system 12 is contemplated. The illustrated embodiment includes the oil separator 30, but an alternative embodiment may not include the oil separator 30.

The condenser 18 is connected to the oil separator 30 and is configured to receive the compressed refrigerant and condense it. The gaseous refrigerant delivered into the condenser 18 is condensed to liquid form by heat exchange with a cooling fluid, such as water or glycol. In some types of refrigeration systems 10, ambient air, as opposed to water, is used as the cooling fluid. The condensed refrigerant, which is still relatively hot and at relatively high pressure, flows from the condenser 18 to and through the expansion device 22.

The expansion device 22 is connected to the condenser 18 and is configured to receive the condensed refrigerant from the condenser 18. In the process of flowing through the expansion device 22, the condensed refrigerant undergoes a pressure drop which causes at least a portion thereof to flash to refrigerant gas and, as a result, causes the refrigerant to be cooled. In some embodiments a restrictor is used in place of or in conjunction with the expansion device 22.

The now cooler two-phase refrigerant is delivered from the expansion device 22 into the evaporator 26, where it is brought into heat exchange contact with a heat exchange medium, such as water or glycol. The heat exchange medium flowing through a tube bundle 54, having been heated by the heat load which it is the purpose of the refrigeration chiller to cool, is warmer than the refrigerant that is brought into heat exchange contact with and rejects heat thereto. The refrigerant is thereby warmed and the majority of the liquid portion of the refrigerant vaporizes.

The medium flowing through the tube bundle 54 is, in turn, cooled and is delivered back to the heat load which may be the air in a building, a heat load associated with a manufacturing process or any heat load which it is necessary or beneficial to cool. After cooling the heat load the medium is returned to the evaporator 26, once again carrying heat from the heat load, where it is again cooled by vaporized refrigerant and the lubricant-liquid refrigerant mixture in an ongoing process. In some embodiments the lubricant migrates from the compressor 14 to the evaporator 26 using the same path as the refrigerant, and may mix with the refrigerant at an earlier point in the refrigeration cycle.

The evaporator 26 includes first and second outlet ports 28, 32. The refrigerant vaporized in the evaporator 26 is drawn out of the evaporator 26 by the compressor 14 which re-compresses the refrigerant and delivers it to the oil separator 30 and then the condenser 18, likewise in a continuous and ongoing process.

Figure 2:
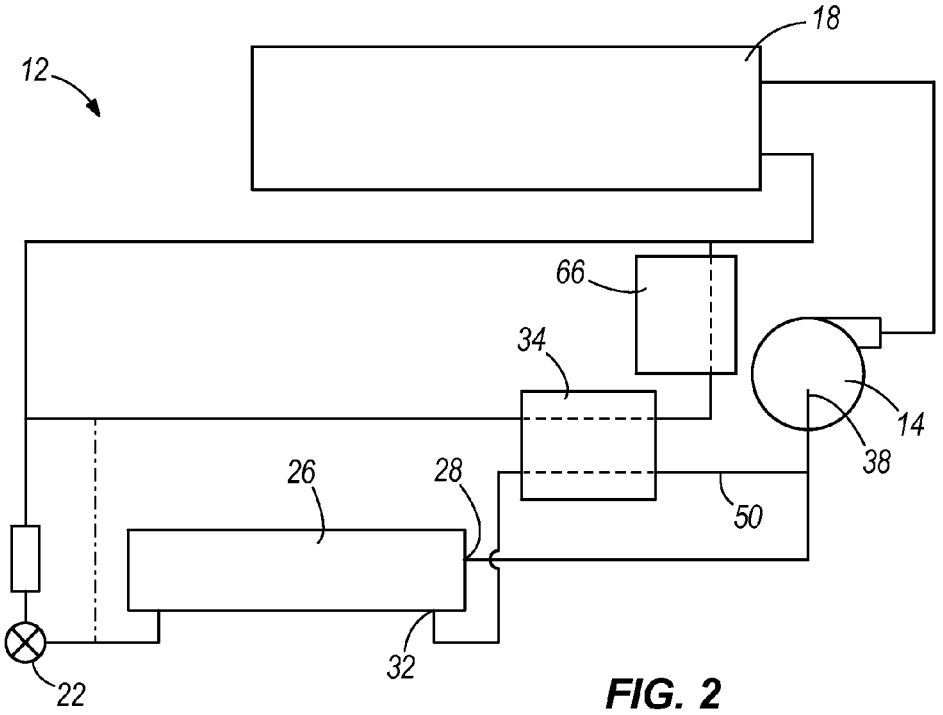
FIG. 2 is a schematic illustration of an alternative embodiment of a refrigeration chiller.

The lubricant entrained in the stream of refrigerant gas delivered from the compressor 14 to the oil separator 30 is separated in the oil separator 30. Lubricant is then passed from the oil separator 30 to the first lubricant return line 46. The first lubricant return line 46 passes through the heat exchanger 34 where it is brought into thermal contact with the lubricant in the second lubricant return line 50. After leaving the heat exchanger 34, the first lubricant return line 46 returns to the compressor 14 where the lubricant is used to lubricate the compressor 14. Lubricant-liquid refrigerant mixture in the evaporator 26 leaves the evaporator 26 via the second outlet port 32, usually on a bottom portion of the evaporator 26. In an alternative embodiment the second lubricant return line 50 returns to the suction port 38, as shown in FIG. 2.

Figure 7:
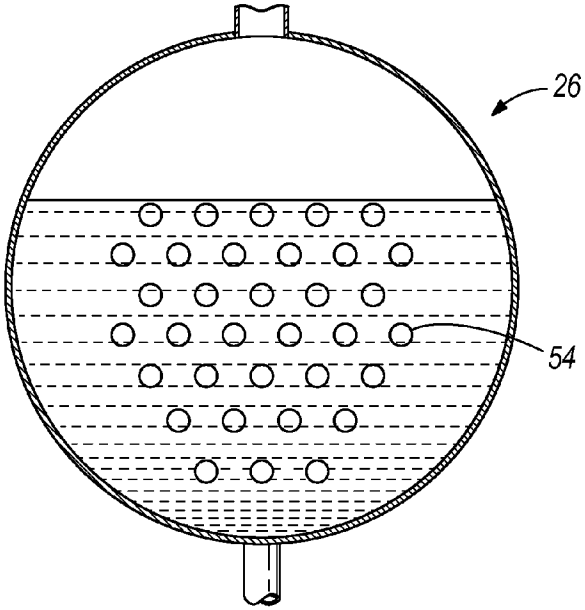
FIG. 7 is a schematic illustration of a flooded shell-and-tube style evaporator.
Figure 8:
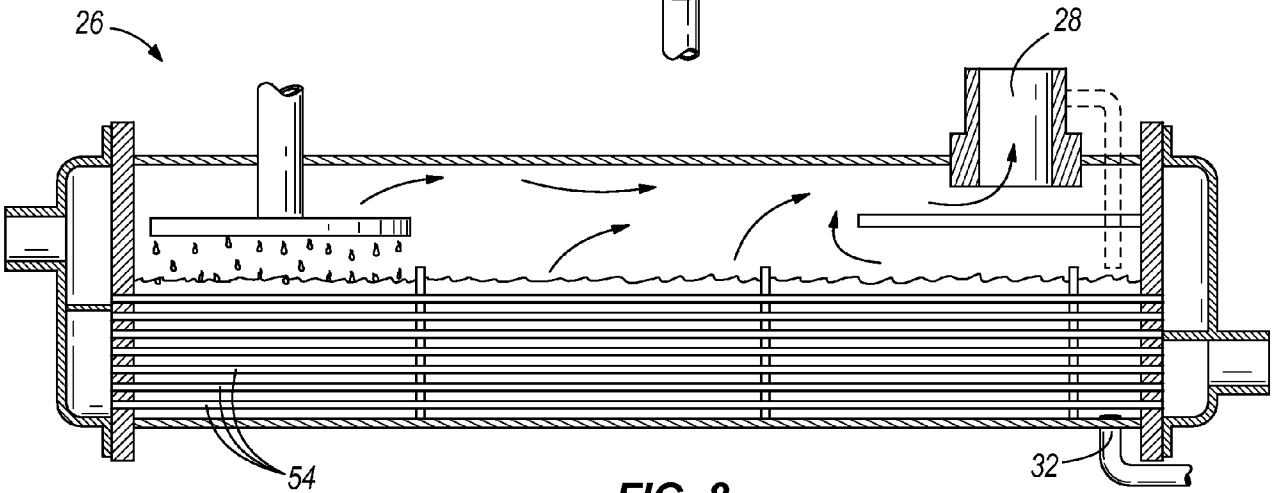
FIG. 8 is a schematic illustration of a flowing pool shell-and-tube style evaporator.

The lubricant-liquid refrigerant mixture that has exited the evaporator 26 via the second outlet port 32 enters the second lubricant return line 50 at the saturated liquid temperature of the evaporator 26. The second lubricant return line 50 passes through the heat exchanger 34 where it is in thermal contact with the lubricant in the first lubricant return line 46, causing the refrigerant in the second lubricant return line 46 to evaporate. Lubricant that is drawn out of the second outlet port 32 exits the heat exchanger 34 in droplets, as opposed to slugs, by oil entrainment. The second lubricant return line 50 is downstream of the heat exchanger 34 and is sized and configured with regard to a saturated suction temperature and a refrigeration capacity of the refrigeration system 12, according to recognized standards such as the table illustrated in FIG. 7. The table illustrated in FIG. 7 is titled "Minimum Refrigeration Capacity in Tons for Oil Entrainment up Suction Risers (Type L Copper Tubing)" and can be found on page 1.20 of the 2010 ASHRAE Handbook (Refrigeration), which is published by the American Society of Heating, Refrigeration, and Air-Conditioning Engineers and has an ISBN number of 978-1-933742-81-6. After leaving the heat exchanger 34, the lubricant-liquid refrigerant mixture in the second lubricant return line 50 returns to the compressor 14 where the lubricant is used to lubricate the compressor 14.

Routing the second lubricant return line 50 through the heat exchanger 34 will create a thermosiphon effect ensuring lubricant return and will result in liquid lubricant and superheated refrigerant vapor returning to the compressor 14 resulting in improved compressor 14 performance. Routing the first lubricant return line 46 through the heat exchanger 34 will reduce the temperature of the lubricant therein and improve the viscosity of the lubricant therein thus improving compressor lubrication, and also lowering sound. The heat exchanger 34 acts as a thermosiphon to ensure that the lubricant-liquid refrigerant mixture passes through the heat exchanger 34. That is, the density of the refrigerant in the first lubricant return line 46 and the mixture that has adsorbed heat from the heat exchanger 34 is different due to the lubricant-liquid refrigerant mixture in the heat exchanger 34 having adsorbed heat and the refrigerant in the heat exchanger 34 being evaporated; this difference in density provides a motive force, i.e. a thermosiphon, to move the mixture through the heat exchanger 34.

The embodiment illustrated in FIG. 1 has several benefits. The heat exchanger 34 allows parasitic heat to be removed from the first portion of refrigerant, thus improving the viscosity of the lubricant-liquid refrigerant mixture. In addition, removing the parasitic heat allows the lubricant-liquid refrigerant mixture that has passed through the evaporator 26 to be superheated, thus improving the quality of the mixture to the compressor 14 and avoiding depressing the suction superheat to the compressors. Furthermore, removing the parasitic heat improves the flow and lowers the temperature of the lubricant passing through the heat exchanger 34 thus passing the cooled lubricant to the compressor 14 which improves compressor lubrication and lowers noise levels. Finally, removing the parasitic heat assists in creating a thermosiphon to the compressor which further minimizes any parasitic losses due to the cooling requirements.

FIG. 2 illustrates an alternative embodiment of the refrigeration system 12 illustrated in FIG. 1 and the same components are assigned the same numerals of reference but will not be described again herein to avoid repetition. In describing the alternative embodiment illustrated in FIG. 2, only the differences between the embodiment illustrated in FIG. 1 and the alternative embodiment will be described.

The compressor 14 illustrated in FIG. 2 is driven by a variable speed drive (VSD), which requires cooling to function properly. An alternative embodiment may include the oil separator 30. The gaseous refrigerant delivered into the condenser 18 is condensed to liquid form by heat exchange with a cooling fluid. The condensed refrigerant, which is still relatively warm and at relatively high pressure, flows from the condenser 18 to and through the expansion device 22.

Before reaching the expansion device 22, a first portion of refrigerant is directed to a VSD heat sink 66. The VSD heat sink 66 serves to cool the VSD. Other components can be cooled in place of or in addition to the VSD heat sink 66. Other components that may need cooling include, by way of example only, electronics, a load inductor or diodes. As the condensed first portion of refrigerant passes through the VSD heat sink 66, the first portion of refrigerant absorbs heat from the VSD heat sink 66, thus cooling the VSD. After leaving the VSD, the first portion of refrigerant passes through the heat exchanger 34.

The first portion of refrigerant is in thermal contact with refrigerant that has passed through the evaporator 26 while the first portion is in the heat exchanger 34. The refrigerant that has passed through the evaporator 26 absorbs heat from the first portion of refrigerant. In an alternative embodiment, the VSD heat sink 66 and the heat exchanger 34 are combined. After the first portion of refrigerant has shed heat to the refrigerant that has passed through the evaporator 26, the first portion of refrigerant is combined with the refrigerant from the condenser 18 that did not pass through the VSD heat sink 66. In the illustrated embodiment the first portion of refrigerant is combined with the refrigerant from the condenser 18 before the expansion device 22. In yet another alternative embodiment (illustrated in phantom in FIG. 2) the two are mixed together after refrigerant which did not pass through the VSD heat sink 66 passes through the expansion device 22. In this alternative embodiment, the refrigeration line connecting the heat exchanger 34 to the point after the expansion device 22 where the two refrigerants are mixed may be sized to restrict the flow of refrigerant, and/or it may include an additional expansion device.

After the refrigerant passes through the expansion device 22 it enters the evaporator 26 where heat is exchanged and lubricant is mixed as described with regard to the embodiment illustrated in FIG. 1. Warmed gaseous refrigerant leaves the first outlet port 28 and enters the suction port 38 of the compressor 14. Lubricant-liquid refrigerant mixture leaves the evaporator 26 through the second outlet port 32 and passes through the heat exchanger 34, where the lubricant is in thermal contact with the first portion of refrigerant. After absorbing heat from the first portion of refrigerant, refrigerant from the lubricant-liquid refrigerant mixture evaporates inducing the flow of the evaporated refrigerant and lubricant-liquid refrigerant mixture to the suction port 38 of the compressor 14. In an alternative embodiment, the lubricant-liquid refrigerant mixture passes through a second expansion valve after leaving the evaporator 26 and before entering the heat exchanger 34 so that the pressure of the lubricant-liquid refrigerant mixture is reduced, thus evaporating refrigerant and cooling the mixture. In yet another alternative embodiment the second lubricant return line 50 returns the lubricant-liquid refrigerant mixture to an auxiliary suction port, as illustrated in FIG. 1. In yet another alternative embodiment the lubricant-liquid mixture that passes the heat exchanger 34 does not pass through the expansion device 22, instead, the lubricant-liquid mixture that has passed through the heat exchanger 34 is passed directly to the evaporator 26.

The heat exchanger 34 acts as a thermosiphon to ensure that the lubricant-liquid refrigerant mixture passes through the heat exchanger 34. That is, the density of the refrigerant that has passed through the VSD heat sink 66 and the mixture that has adsorbed heat from the heat exchanger 34 is different due to the lubricant-liquid refrigerant mixture in the heat exchanger 34 having adsorbed heat and the refrigerant in the heat exchanger 34 being evaporated; this difference in density provides a motive force, i.e. a thermosiphon, to move the mixture through the heat exchanger 34.

The embodiment illustrated in FIG. 2 has several benefits. The heat exchanger 34 allows parasitic heat to be removed from the first portion of refrigerant, thus providing additional subcooling enhancing the performance of the evaporator 26. In addition, removing the parasitic heat allows the lubricant-liquid refrigerant mixture that has passed through the evaporator 26 to be superheated, thus improving the quality of the mixture to the compressor 14 and avoiding depressing the suction superheat to the compressor 14. Furthermore, removing the parasitic heat improves the flow and raises the temperature of the lubricant passing through the heat exchanger 34 thus passing the warmed lubricant to the compressor 14 which improves compressor lubrication. Finally, removing the parasitic heat assists in creating a thermosiphon to the compressor 14 which further minimizes any parasitic losses due to the VSD cooling requirements.

Figure 10:
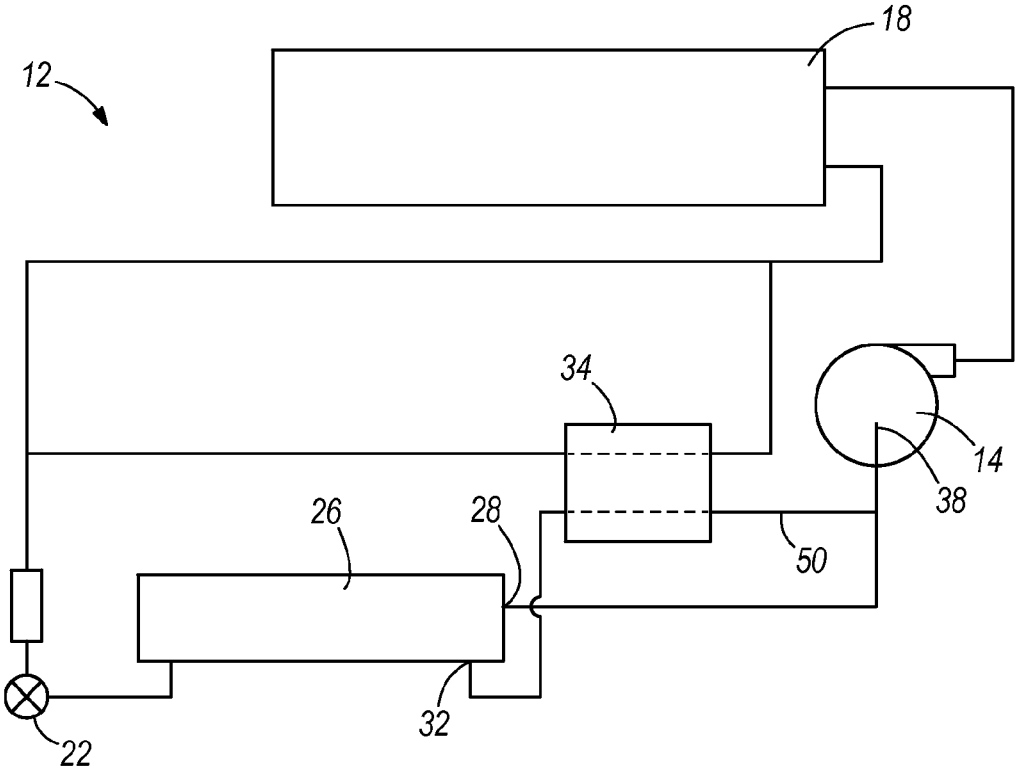
FIG. 10 is a schematic illustration of yet another alternative embodiment of a refrigeration chiller.

FIG. 10 illustrates an alternative embodiment of the refrigeration system 12 illustrated in FIG. 1 and the same components are assigned the same numerals of reference but will not be described again herein to avoid repetition. In describing the alternative embodiment illustrated in FIG. 10, only the differences between the embodiment illustrated in FIG. 1 and the alternative embodiment will be described.

The compressor 14 illustrated in FIG. 10 compresses refrigerant which is then passed into the condenser 18, where the refrigerant is condensed to liquid form by heat exchange with a cooling fluid. The condensed refrigerant, which is still relatively warm and at relatively high pressure, flows from the condenser 18 to and through the expansion device 22.

Before reaching the expansion device 22, a first portion of refrigerant is directed to the heat exchanger 34. The first portion of refrigerant is in thermal contact with refrigerant that has passed through the evaporator 26 while the first portion is in the heat exchanger 34. The refrigerant that has passed through the evaporator 26 absorbs heat from the first portion of refrigerant. After the first portion of refrigerant has shed heat to the refrigerant that has passed through the evaporator 26, the first portion of refrigerant is combined with the refrigerant from the condenser 18 that did not pass through the heat exchanger 34. In the illustrated embodiment the first portion of refrigerant is combined with the refrigerant from the condenser 18 before the expansion device 22. In an alternative embodiment the two are mixed together after refrigerant which did not pass through the heat exchanger 34 passes through the expansion device 22.

After the refrigerant passes through the expansion device 22 it enters the evaporator 26 where heat is exchanged and lubricant is mixed as described with regard to the embodiment illustrated in FIG. 1. Warmed gaseous refrigerant leaves the first outlet port 28 and enters the suction port 38 of the compressor 14. Lubricant-liquid refrigerant mixture leaves the evaporator 26 through the second outlet port 32 and passes through the heat exchanger 34, where the lubricant is in thermal contact with the first portion of refrigerant. After absorbing heat from the first portion of refrigerant, refrigerant from the lubricant-liquid refrigerant mixture evaporates inducing the flow of the evaporated refrigerant and lubricant-liquid refrigerant mixture to the suction port 38 of the compressor 14. In an alternative embodiment, the lubricant-liquid refrigerant mixture passes through a second expansion valve after leaving the evaporator 26 and before entering the heat exchanger 34 so that the pressure of the lubricant-liquid refrigerant mixture is reduced, thus evaporating refrigerant and cooling the mixture. In yet another alternative embodiment the second lubricant return line 50 returns the lubricant-liquid refrigerant mixture to an auxiliary suction port, as illustrated in FIG. 1. In yet another alternative embodiment the lubricant-liquid mixture that passes the heat exchanger 34 does not pass through the expansion device 22, instead, the lubricant-liquid mixture that has passed through the heat exchanger 34 is passed directly to the evaporator 26.

The embodiment illustrated in FIG. 10 has several benefits. The heat exchanger 34 allows parasitic heat to be removed from the first portion of refrigerant, thus providing additional subcooling enhancing the performance of the evaporator 26. In addition, removing the parasitic heat allows the lubricant-liquid refrigerant mixture that has passed through the evaporator 26 to be superheated, thus improving the quality of the mixture to the compressor 14 and avoiding depressing the suction superheat to the compressor 14. Furthermore, removing the parasitic heat improves the flow and raises the temperature of the lubricant passing through the heat exchanger 34 thus passing the warmed lubricant to the compressor 14 which improves compressor lubrication. Finally, removing the parasitic heat assists in creating a thermosiphon to the compressor 14 which allows for more efficient operation of the compressor 14

Figure 3:
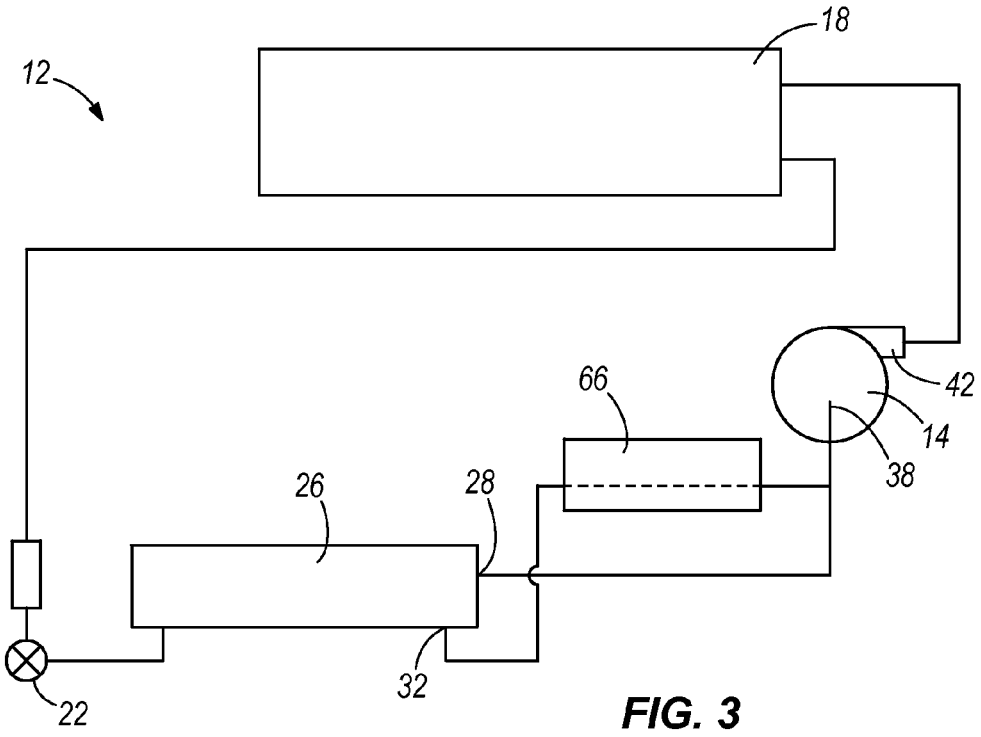
FIG. 3 is a schematic illustration of yet another alternative embodiment of a refrigeration chiller.

FIG. 3 illustrates an alternative embodiment of the refrigeration system 12 illustrated in FIG. 1 and the same components are assigned the same numerals of reference but will not be described again herein to avoid repetition. In describing the alternative embodiment illustrated in FIG. 3, only the differences between the embodiment illustrated in FIG. 1 and the alternative embodiment will be described.

The refrigerant system 12 illustrated in FIG. 3 uses the VSD and the VSD heat sink 66 as described in relation to the embodiment illustrated in FIG. 2. In the refrigeration system 12 illustrated in FIG. 3 all refrigerant that is compressed by the compressor 14 is sent to the condenser 18. After leaving the condenser 18, the refrigerant passes through the expansion device 22 and enters the evaporator 26 where it mixes with a lubricant, as described in relation to the embodiment illustrated in FIG. 1. The lubricant-liquid refrigerant mixture is taken from the second outlet port 32 of the evaporator 26 and is fed through the VSD heat sink 66, thus cooling the VSD and evaporating refrigerant in the lubricant-liquid refrigerant mixture. The VSD heat sink 66 acts as a thermosiphon to aid in the passage of the mixture through the VSD heat sink 66. After passing through the VSD heat sink 66, the lubricant-liquid refrigerant mixture is combined with the lubricant-liquid refrigerant mixture that passed through the first outlet port 28 of the evaporator 26, and both are returned to the suction port 38 of the compressor 14. In an alternative embodiment, the lubricant-liquid refrigerant mixture that passes through the second outlet port 32 is also passed through a second expansion valve before it is fed through the VSD heat sink 66. In yet another alternative embodiment the refrigeration system 12 includes an oil separator which receives refrigerant directly from the compressor discharge port 42, separates lubricant from the refrigerant, and returns the separated lubricant to the compressor 14. In an alternative embodiment an oil separator and associated lines is combined with the system illustrated in FIG. 3. In yet another alternative embodiment the second lubricant return line 50 returns the lubricant-liquid refrigerant mixture to an auxiliary suction port, as illustrated in FIG. 1.

The embodiment illustrated in FIG. 3 has several benefits. The refrigeration system 12 removes parasitic heat from the VSD heat sink 66, thus improving the quality of the lubricant and refrigerant that is returned to the compressor 14. In addition, the refrigeration system 12 inhibits the return of liquid refrigerant return to the compressor 14, which can reduce the superheat. The refrigeration system 12 utilizes the heat provided by the VSD to vaporize the refrigerant from the lubricant-liquid refrigerant mixture passing through the VSD heat sink 66, which improves flow and quality of the lubricant and raises the temperature of the lubricant returning to the compressor 14 which improves compressor 14 lubrication. Finally, removing the parasitic heat assists in creating a thermosiphon to the compressor 14 which further minimizes any parasitic losses due to the VSD cooling requirements.

Figure 4:
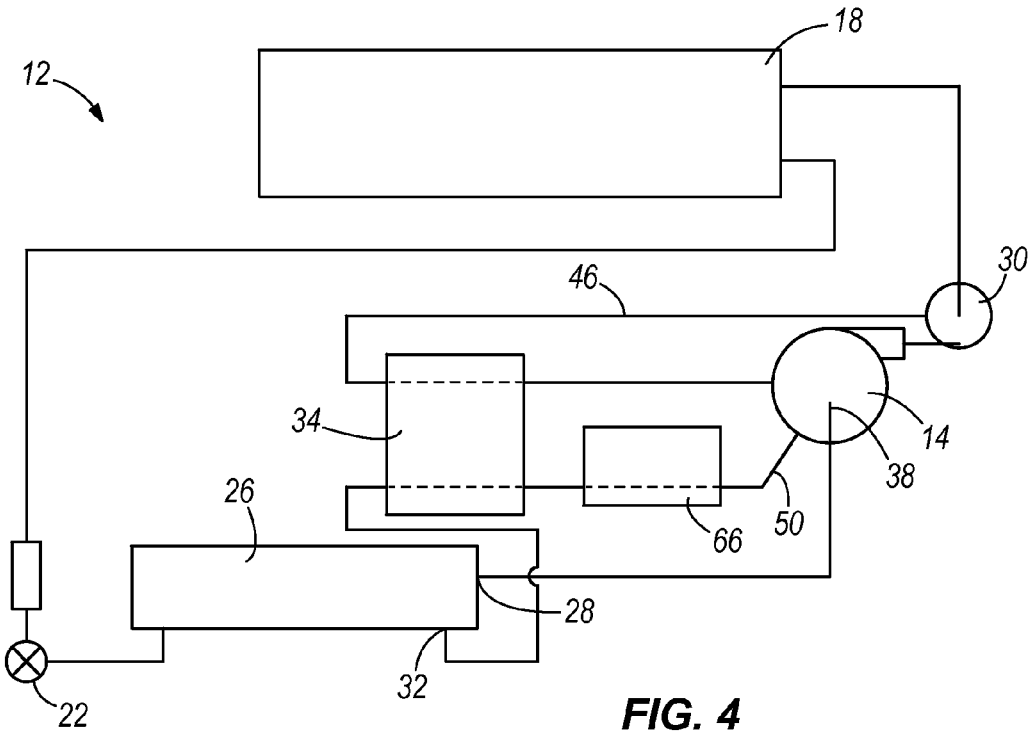
FIG. 4 is a schematic illustration of yet another alternative embodiment of a refrigeration chiller.

FIG. 4 illustrates an alternative embodiment of the refrigeration system 12 illustrated in FIG. 1 and the same components are assigned the same numerals of reference but will not be described again herein to avoid repetition. In describing the alternative embodiment illustrated in FIG. 4, only the differences between the embodiment illustrated in FIG. 1 and the alternative embodiment will be described.

The refrigerant system 12 illustrated in FIG. 4 uses the VSD and the VSD heat sink 66 as described in relation to the embodiment illustrated in FIG. 2. In the refrigeration chiller illustrated in FIG. 4 refrigerant is compressed and passed to the oil separator 30, where lubricant is removed from the refrigerant and the lubricant is then passed to the first lubricant return line 46. The lubricant in the first lubricant return line 46 then passes through the heat exchanger 34, where the lubricant in the first lubricant return line 46 is in thermal contact with the lubricant in the second lubricant return line 50. The lubricant in the first lubricant return line 46 transfers heat to the lubricant in the second lubricant return line 50. The lubricant in both the first and second lubricant return lines 46, 50 is then returned to the compressor 14.

The refrigerant from the oil separator 30 is then passed to the condenser 18. After leaving the condenser 18, the refrigerant passes through the expansion device 22 and enters the evaporator 26 where it mixes with a lubricant, as described in relation to the embodiment illustrated in FIG. 1. Lubricant-liquid refrigerant mixture is taken from the bottom of the evaporator 26 and exits the second outlet port 32, the lubricant-liquid refrigerant mixture then entering the second lubricant return line 50. The second lubricant return line 50 passes through the heat exchanger 34 where the lubricant-liquid refrigerant mixture in the second lubricant return line 50 receives heat from the lubricant in the first lubricant return line 46. The lubricant-liquid refrigerant mixture in the second lubricant return line 50 then passes through the VSD heat sink 66 where the lubricant-liquid refrigerant mixture receives heat from the VSD heat sink 66. The refrigerant from the lubricant-liquid refrigerant mixture in the second lubricant return line 50 is vaporized as it passes through at least one of the heat exchanger 34 and the VSD heat sink 66, thus creating a thermosiphon effect. After passing through the VSD heat sink 66, the lubricant-liquid refrigerant mixture returns to the compressor 14. In an alternative embodiment, the lubricant-liquid refrigerant mixture in the second lubricant return line 50 may pass through a second expansion valve before entering the heat exchanger 34. Lubricant-liquid refrigerant mixture leaves the evaporator 26 through the first outlet port 28 and is passed to suction port 38 of the compressor 14. In an alternative embodiment the second lubricant return line 50 returns to the suction port 38, as shown in FIG. 2.

The heat exchanger 34 acts as a thermosiphon to ensure that the lubricant-liquid refrigerant mixture passes through the heat exchanger 34. That is, the density of the refrigerant in the first lubricant return line 46 and the mixture that has adsorbed heat from the heat exchanger 34 is different due to the lubricant-liquid refrigerant mixture in the heat exchanger 34 having adsorbed heat and the refrigerant in the heat exchanger 34 being evaporated; this difference in density provides a motive force, i.e. a thermosiphon, to move the mixture through the heat exchanger 34.

The refrigeration system 12 illustrated in FIG. 4 provides several benefits. The lubricant in both the first and second lubricant return lines 46, 50 improves compressor 14 lubrication. The thermosiphon effect that is created by routing the second lubricant return line 50 through at least one of the heat exchanger 34 and the VSD heat sink 66 ensures lubricant is returned to the compressor 14. The routing of the second lubricant return line 50 through the VSD heat sink 66 also ensures that superheated refrigeration vapor returns to the compressor 14 resulting in improved compressor performance and reliability. Another benefit of the refrigeration chiller is that the second lubricant return line 50 being routed through the heat exchanger 34 reduces the fluid temperature and improves the viscosity of lubricant delivered to the compressor 14 thus facilitating lubrication and lowering sound levels. Finally, removing the parasitic heat assists in creating a thermosiphon to the compressor 14 which further minimizes any parasitic losses due to the VSD cooling requirements.

Figure 5:
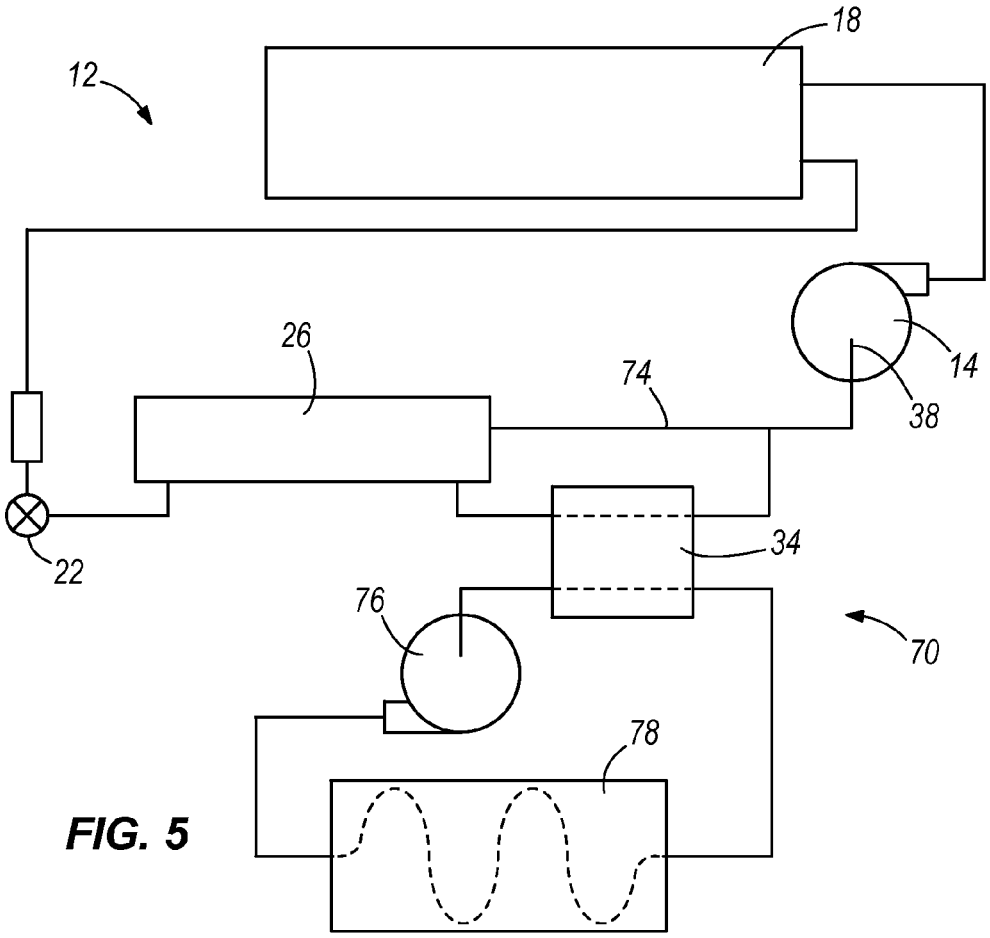
FIG. 5 is a schematic illustration of a refrigeration chiller with a cooling loop.

A refrigeration system 12 with an electronics cooling loop 70 is schematically illustrated in FIG. 5. The refrigeration system 12 is similar to the refrigeration system 12 illustrated in FIG. 3. Thus the same components are assigned the same numerals of reference but will not be described again herein to avoid repetition. In describing the alternative embodiment illustrated in FIG. 5, only the differences between the embodiment illustrated in FIG. 1 and the alternative embodiment will be described.

The refrigeration system 12 with an electronics cooling loop 70 includes the heat exchanger 34. Lubricant-liquid refrigerant mixture is taken from the bottom of the evaporator 26 and is fed through the heat exchanger 34 where the mixture adsorbs heat. The heat exchanger 34 acts as a thermosiphon to ensure that the lubricant-liquid refrigerant mixture passes through the heat exchanger 34, that is, the density of the refrigerant in a refrigerant return line 74 and the mixture that has adsorbed heat from the heat exchanger 34 is different due to the lubricant-liquid refrigerant mixture in the heat exchanger 34 having adsorbed heat and a portion of the refrigerant in the heat exchanger 34 being evaporated; this difference in density provides a motive force, i.e. a thermosiphon, to move the mixture through the heat exchanger 34. After passing through the heat exchanger 34, the lubricant-liquid refrigerant mixture is combined with the refrigerant in the refrigerant return line 74 and both are returned to the suction port 38. In an alternative embodiment the lubricant-liquid refrigerant mixture is passed through a second expansion valve before it is fed through the heat exchanger 34. In yet another alternative embodiment the heat exchanger 34 is arranged such that gravity provides the motive force to take lubricant-liquid refrigerant mixture from the evaporator 26, pass it through the heat exchanger 34 and return it to the compressor 14. In yet another alternative embodiment an oil separator, as described with regard to FIG. 1, is utilized with the embodiment illustrated in FIG. 5. In yet another alternative embodiment the second lubricant return line 50 returns the lubricant-liquid refrigerant mixture to an auxiliary suction port, as illustrated in FIG. 1.

The electronics cooling loop 70 contains a coolant, such as glycol. The electronics cooling loop 70 includes a circulation pump 76, the heat exchanger 34, and a heat sink 78. The circulation pump 76 serves to circulate coolant in the cooling loop 70, the heat exchanger 34 serves to facilitate the exchange of heat between the coolant in the coolant loop 70 and the lubricant-liquid refrigerant mixture from the evaporator 26, and the heat sink 34 serves to adsorb heat from components that need cooling, such as, by way of example only, electronics, a load inductor, diodes or a variable speed drive. In one embodiment the heat exchanger 34 is a brazed plate heat exchanger. In the illustrated embodiment the coolant flows from the circulation pump 76 to the heat sink 78, from the heat sink 78 to the heat exchanger 34, and from the heat exchanger 34 to the coolant pump 76. In an alternative embodiment, the coolant flows in the opposite direction.

The refrigeration system 12 with an electronics cooling loop 70 has several benefits. Lubricant-liquid refrigerant mixture that would ordinarily be trapped in the evaporator 26 is removed from the evaporator 26 and returned to the compressor 14 which helps to ensure adequate compressor lubrication. In addition, the lubricant-liquid refrigerant mixture that returns to the compressor 14 is of higher quality (in this case quality refers to the ratio of vapor to liquid refrigerant) because the heat adsorbed by the lubricant-liquid refrigerant mixture serves to evaporate refrigerant from the lubricant-liquid refrigerant mixture, in addition to inducing flow to the compressor. Beneficial component cooling is accomplished by the cooling loop 70. The coolant loop 70 is also able to adsorb some heat from the components even when the compressor 14 is shut down, thus prolonging the time that the components may be run after the compressor 14 is not operating. In addition, the coolant loop 70 contains a liquid coolant and does not rely on refrigerant, so there is always liquid present in the cooling loop 70. Yet another benefit of the refrigeration system 12 with electronics cooling loop 70 is that the heat sink 78 and/or electrical components to be cooled do not need to be in close proximity to the compressor 14.

It is to be noted that by the development of the thermosiphonic flow from the heat exchanger 34 to the suction port 38, as a result of the density differences between the refrigerant in the refrigerant return line 74 and the lubricant-liquid refrigerant mixture that has adsorbed heat from the heat exchanger 34, and with the assistance of the motive force of gravity due to the arrangement of the evaporator 26 and the heat exchanger 34, self-sustaining flow of the lubricant-liquid refrigerant mixture is established and maintained without the need for mechanical or electromechanical apparatus, valving or controls to cause or regulate the flow of lubricant-liquid refrigerant mixture. As such, the cooling arrangement of the present invention is reliable, simple and economical while minimizing the adverse effects on refrigeration system efficiency that are attendant in other refrigeration system oil cooling schemes. It is to be further noted that the rate of the flow of lubricant-liquid refrigerant mixture is proportional to the magnitude of heat exchange between the lubricant-liquid refrigerant mixture and the heat exchanger 34, and by the arrangement of the evaporator 26 and the heat exchanger 34. In an alternative embodiment, a restrictor is placed between the evaporator 26 and the heat exchanger 34 to limit flow of lubricant-liquid refrigerant mixture to a preset maximum flow.

Thus, the invention provides, among other things, a refrigeration system. Various features and advantages of the invention are set forth in the following claims.

What is claimed is:

1. A refrigeration system, comprising:

a compressor having a suction port and a discharge port, the compressor being configured to receive a heat exchange fluid from the suction port, compress the heat exchange fluid, and discharge the compressed heat exchange fluid through the discharge port;

a condenser fluidly connected to the discharge port and being configured to receive the compressed heat exchange fluid from the compressor and condense the compressed heat exchange fluid;

an expansion device fluidly connected to the condenser and configured to receive the condensed heat exchange fluid from the condenser;

an evaporator having an inlet port, a first outlet port, and a second outlet port, the evaporator being configured to receive heat exchange fluid from the expansion device through the inlet port, evaporate a portion of the heat exchange fluid, and discharge the evaporated portion of the heat exchange fluid through the first outlet port to a line fluidly connected to the suction port;

a fluid line fluidly connecting the second outlet port to the suction port;

a heat sink;

a heat exchanger fluidly connected to the fluid line; and a coolant loop connecting the heat sink and the heat exchanger and configured to circulate a coolant between the heat sink and the heat exchanger such that heat from an electronic device is transferred to the heat sink, heat from the heat sink is transferred to the coolant, heat from the coolant is transferred to the heat exchange fluid in the heat exchanger to cool the coolant, the heat sink, and the electronic device.

2. The refrigeration system according to claim 1, wherein the heat sink cools a variable speed drive.

3. The refrigeration system according to claim 2, wherein the compressor is driven by the variable speed drive.

4. The refrigeration system according to claim 3, wherein the compressor is a screw compressor.

5. The refrigeration system according to claim 1, wherein the heat exchange fluid is a refrigerant.

6. The refrigeration system according to claim 1, wherein the heat exchanger is a brazed plate heat exchanger.

7. The refrigeration system according to claim 1, further comprising a restrictor disposed on the fluid line between the second outlet port and the heat exchanger.

8. A refrigeration system comprising:

a compressor having a suction port and a discharge port, the compressor configured to receive a heat exchange fluid from the suction port;

a variable-speed-drive device configured to drive the compressor to compress the heat exchange fluid and discharge the compressed heat exchange fluid through the discharge port;

a condenser fluidly connected to the discharge port and configured to receive the compressed heat exchange fluid from the compressor and to condense the compressed heat exchange fluid;

an expansion device fluidly connected to the condenser and configured to receive the condensed heat exchange fluid from the condenser;

a shell-and-tube style evaporator having an inlet port, a first outlet port, and a second outlet port, wherein the evaporator is configured to receive the heat exchange fluid from the expansion device through the inlet port, evaporate a portion of the heat exchange fluid, and discharge the evaporated portion of the heat exchange fluid through the first outlet port to a line fluidly connected to the suction port;

a fluid line fluidly connecting the second outlet port to the suction port;

a heat sink;

a heat exchanger fluidly connected to the fluid line; and a coolant loop connecting the heat sink and the heat exchanger and configured to circulate a coolant between the heat sink and the heat exchanger such that heat from an electronic device is transferred to the heat sink, heat from the heat sink is transferred to the coolant, heat from the coolant is transferred to the heat exchange fluid in the heat exchanger to cool the coolant, the heat sink, and the electronic device.

9. The refrigeration system according to claim 8, wherein the compressor is a screw compressor.

10. The refrigeration system according to claim 8, wherein the heat exchange fluid is a refrigerant.

11. The refrigeration system according to claim 8, wherein the heat sink cools the variable speed drive.

12. The refrigeration system according to claim 8, wherein the heat exchanger is a brazed plate heat exchanger.

13. The refrigeration system according to claim 8, further comprising a restrictor disposed on the fluid line between the second outlet port and the heat exchanger.

14. A method of cooling a medium to be cooled comprising:

compressing a heat exchange fluid using a compressor;

condensing the heat exchange fluid using a condenser;

expanding compressed heat exchange fluid with an expansion device;

receiving the compressed heat exchange fluid in an evaporator through an inlet port;

evaporating a portion of the heat exchange fluid contained in the evaporator;

discharging the evaporated portion of the heat exchange fluid through a first outlet port of the evaporator to a line fluidly connected to the suction port of the compressor;

discharging the heat exchange fluid from a second outlet port of the evaporator to a return line in thermal contact with a heat sink;

passing the discharged heat exchange fluid through a heat exchanger; and circulating a coolant between the heat exchanger and a heat sink for an electronic device to remove heat from the heat sink and discharge the heat to the discharged heat exchange fluid.

15. The method according to claim 14, further comprising driving the compressor using a variable speed drive.

16. The method according to claim 14, wherein the electronic device is in thermal contact with the heat sink.

17. The method according to claim 14, wherein the compressor is a screw compressor.

18. The method according to claim 14, further comprising restricting the flow of the heat exchange fluid between the second outlet port and the heat exchanger.

19. The method according to claim 14, wherein the heat exchange fluid is a refrigerant.

* * * * *